United States Patent [19]

Pierce et al.

[11] Patent Number: 4,708,346

[45] Date of Patent: Nov. 24, 1987

[54] GOLF CLUB WITH ALIGNMENT DEVICE

[76] Inventors: Milton R. Pierce; Elizabeth C. Pierce, both of 333 Club Manor Dr., Sun City Center, Fla. 33570

[21] Appl. No.: 939,637

[22] Filed: Dec. 9, 1986

[51] Int. Cl.[4] ..... A63B 69/36; A63B 53/04

[52] U.S. Cl. ..... 273/164; 273/183 D

[58] Field of Search ..... 273/164, 183 D, 183 E, 273/163 R, 163 A, 193 R, 194 A

[56] References Cited

U.S. PATENT DOCUMENTS 1,485,272 2/1924 Kinsman ..... 273/164

3,722,887 3/1973 Cochran et al. ..... 273/77 A 4,128,244 12/1978 Duclos ..... 273/163 A 4,550,914 11/1985 McCallister ..... 273/183 D

*Primary Examiner*—George J. Marlo

*Attorney, Agent, or Firm*—Pettis & McDonald

[57] ABSTRACT

A grip and swing alignment device is provided on a golf club face in the form of a visible stripe extending through the desired ball contacting area of the club face and being aligned such that, when viewed from directly ahead of the club face, a plane including the viewer's eye and a lengthwise extension of the stripe extends generally through the longitudinal center of the club hand grip.

3 Claims, 3 Drawing Figures

GOLF CLUB WITH ALIGNMENT DEVICE

BACKGROUND OF THE INVENTION

The present invention relates generally to golf clubs that include alignment devices for positioning a golfer's hands upon the grip of the club and for aligning the club with a ball to be hit.

In the game of golf the fundamental requirement for success is a proper swing of the club up to and engaging the ball to be hit. This is true whether the club is a wood or an iron. To achieve the proper swing and engagement of the ball, it is critical not only that the swing of the golfer's arm be proper but also that his or her grip on the club be proper and the club be aligned properly with the ball to be hit. Specifically, it is necessary that the club head be square with the ball at its point of contact in order to drive the ball straight in the direction of choice without hooking or slicing. Additionally, it is important that the golfer's hands be in such a position to locate the hinges of the golfer's wrists in such a way to cause the wrist hinges to pivot or break properly on the backswing and to release squarely at the ball on the downswing. In the past this positioning of the grip and guiding of the swing has been the most difficult aspect of a proper golf swing. To obtain a proper such swing, it would be desirable to prevent on each golf club an alignment device to assist a golfer in positioning his hands and directing the club face in the proper orientation.

SUMMARY OF THE INVENTION

It is an object of the present invention to provide a golf club with an alignment device that forms a portion of the club head. This alignment device would provide visual clues for assisting the golfer in both orienting the club with respect to the ball and for positioning his hands upon the grip of the golf club to achieve the desired swing. It is another object of this invention to provide such an alignment device that may be made integrally with or added to an existing golf club. To achieve these and other objects that will become apparent, the present invention provides a golf club having a swing aligning device for assisting a golfer in positioning his hands upon the club and guiding his swing of the club to a golf ball. The club of this invention includes a shaft having a longitudinally extending hand grip affixed at one end thereof and a club head affixed at the opposite end thereof, such club head including a visible stripe on the ball contacting face, which stripe extends through the desired ball contacting area of the club face and is aligned such that, when the club head is in its ball addressing position on a playing surface and is viewed horizontally from directly ahead of the club face, an extension of the stripe extends generally through the longitudinal center of the shaft and grip. In a preferred embodiment of this invention the stripe is so positioned on the club face that, when the club is properly gripped and held by a golfer in the ball addressing position, an extension of the stripe as viewed by the golfer will be generally perpendicular to a line that is generally parallel to the back of the upper hand of the golfer on the shaft grip.

BRIEF DESCRIPTION OF THE DRAWINGS

The present invention will be described in detail in respect to the illustrations in which.

DESCRIPTION OF A PREFERRED EMBODIMENT

Figure 1:
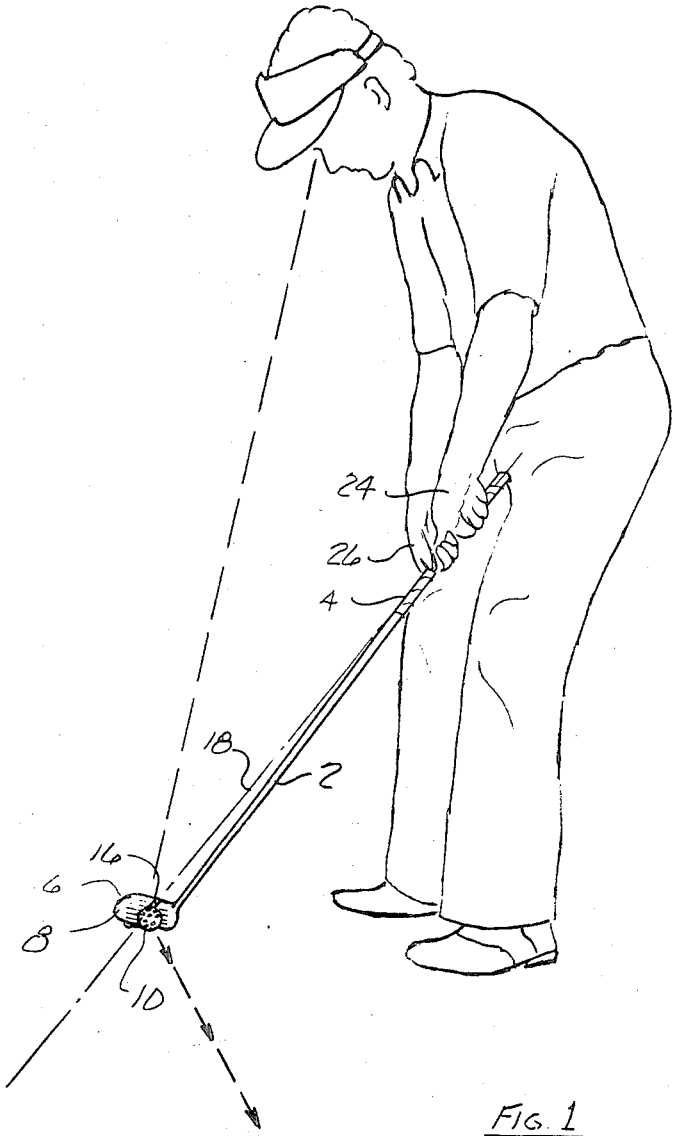
FIG. 1 is a perspective view of a golfer holding a club according to the present invention.
Figure 2:
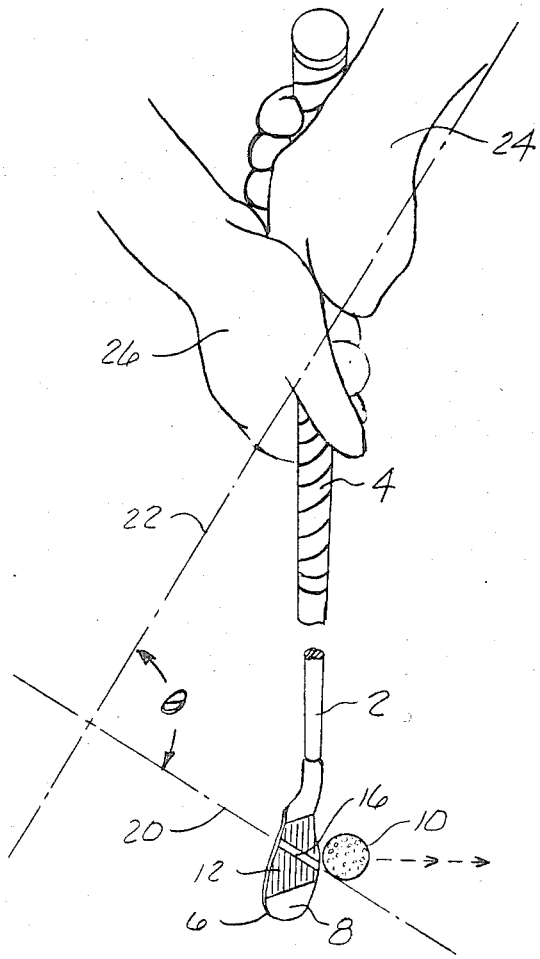
FIG. 2 is a top view, as seen by a golfer, of the club of the present invention illustrating a proper grip on such club.
Figure 3:
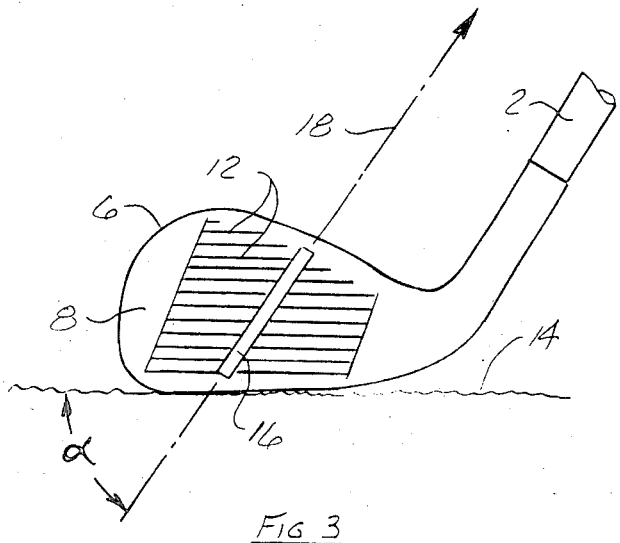
FIG. 3 is a horizontal view from directly ahead of the face of the club of this invention, illustrating the angle of the swing aligning stripe with respect to the horizontal.

A preferred embodiment of the golf club of the present invention is illustrated in FIGS. 1 through 3. These illustrations depict a particular iron, although the invention may be applied equally to any or all of the irons and woods in a complete set of golf clubs.

As shown in the illustrations, a golf club includes a shaft 2 having a hand grip 4 affixed at one end thereof and a club head 6 affixed at the opposite end thereof. The club head 6 includes a ball contacting face 8, which is generally angled upwardly to impart loft to the ball 10 when struck by the club. Different clubs of a given set will include different angles of loft in a known manner. On this ball contacting face 8 are provided a series of grooves 12, generally extending horizontally when the club is in its ball addressing position on a playing surface 14, that impart a desired degree of backspin to a ball when hit.

In the present invention there is provided on the ball contacting face of the club a stripe 16, which may be formed by lines etched or machined into the face of the club or by applying color, as by a paint or coating or by applying a contrasting texture, such as by etching or sandblasting that portion. All that is required is that such stripe 16 be visible to the golfer when holding the club in the ball addressing position shown in FIGS. 1 and 2.

This stripe 16 extends through the desired ball contacting area or "sweet spot" of the club face and is aligned such that, when club head is in its ball addressing position on a playing surface 14 and is viewed horizontally from directly ahead of the club face, as in FIG. 3, a plane including the viewer's eye and a lengthwise extension 18 of the stripe 16 extends through a point generally midway the upper and lower ends of the shaft hand grip, as shown in FIG. 1. Depending upon the angle of loft of the club face and other features unique to each particular club, it has been found that such a stripe 16 makes an angle $\alpha$, as shown on FIG. 3, with the horizontal when so viewed that is in the range of about 53° to about 60°.

By aligning this stripe 16 in the manner recited, this line 18 will define the dynamic swing line, which is the vector of the centrifugal force between the grip of the golfer and the desired point of ball contact on the club face when the club is swung. This assists the golfer in aligning his swing and the club face squarely with the desired direction by use of the horizontal grooves 12 on the club face.

As shown most clearly in FIG. 2, the stripe 16 also provides the necessary visual cue to the golfer for proper placement of his hands on the grip 4 of the club shaft. When this stripe 16 is viewed from above, as through the golfer's eyes, for the particular club illustrated in the FIG. 1 through 3, the stripe 16 will appear to have an extension as indicated by the line 20 in FIG. 2. When the golfer's hands are properly placed upon the grip 4 for a proper swing and accurate shot, with the club held in the ball addressing position shown in FIG. 2, the extension 20 of the stripe 16 will appear to the golfer's eyes to be generally perpendicular to a line 22 that is generally parallel to the back of the upper hand 24 of the golfer on the shaft grip 4. Correspondingly, when the lower hand 26 is properly positioned, a plane through and normal to the axis of the hinge of the wrist of that lower hand, the golfer's right hand in FIG. 2, will extend parallel to the extension 20 of the stripe 16. When the golfer's hands are placed in this manner on the club grip, the wrist hinges will break properly on the backswing and will release squarely at the ball on the downswing. The wrist hinges will thus be in proper alignment to release through the ball squarely at the point of impact as illustrated in FIG. 2. This will provide for a smoother and more accurate swing and contact with the ball by positioning the wrist hinges perpendicular to the plane of the swing.

Numerous variations and modifications of the present invention, all within the scope of this invention, will readily occur to those skilled in the art. Such modifications may include, without limitation, the provision of stripes 16 in differing widths, lengths, and materials, among other variations. All such modifications and variations are considered to be fully within the scope of this invention. Accordingly, the foregoing detailed description is to be considered illustrative only of the principles of this invention and not to be limitative thereof. The scope of this invention is to be determined solely by the claims appended thereto.

What is claimed is:

1. A golf club having a swing aligning device for assisting a golfer in positioning his hands upon the club and guiding his swing of the club to a golf ball, said club comprising a shaft having a longitudinally extending hand grip affixed at one end thereof and a club head affixed at the opposite end thereof;

said club head including a visible stripe on the ball contacting face thereof, said stripe extending through the desired ball contacting area of said club face and being aligned such that, when said club head is in its ball addressing position on a playing surface and is viewed horizontally from directly ahead of said club face, a plane including the viewer's eye and a lengthwise extension of said stripe extends through a point generally midway the upper and lower ends of said shaft hand grip.

2. The golf club of claim 1 wherein said stripe makes an angle in the range of about 53° to about 60° with the horizontal when so viewed.

3. The golf club of claim 1 wherein said stripe is so positioned on said club face that, when said club is properly gripped and held by a golfer in the ball addressing position, an extension of said stripe as viewed by the golfer will be generally perpendicular to a line generally parallel to the back of the upper hand of said golfer on said shaft grip.

* * * * *

UNITED STATES PATENT AND TRADEMARK OFFICE

CERTIFICATE OF CORRECTION

PATENT NO. : 4,708,346

DATED : November 24, 1987

INVENTOR(S) : Pierce et al.

It is certified that error appears in the above-identified patent and that said Letters Patent are hereby corrected as shown below:

Column 1, line 27, "prevent" should read -- provide --.

Signed and Sealed this

Twenty-sixth Day of April, 1988

*Attest:*

DONALD J. QUIGG

*Attesting Officer*

*Commissioner of Patents and Trademarks*